US005208140A

United States Patent [19]

Nishijima

[11] Patent Number: 5,208,140

[45] Date of Patent: May 4, 1993

[54] LIGHT-SENSITIVE SILVER HALIDE PHOTOGRAPHIC MATERIAL PREVENTED IN COLOR CONTAMINATION

[75] Inventor: Toyoki Nishijima, Odawara, Japan

[73] Assignee: Konica Corporation, Tokyo, Japan

[21] Appl. No.: 764,369

[22] Filed: Sep. 23, 1991

[30] Foreign Application Priority Data

Sep. 25, 1990 [JP] Japan ..... 2-256125
Nov. 30, 1990 [JP] Japan ..... 2-336717

[51] Int. Cl.[5] ..... G03C 7/38; G03C 1/34
[52] U.S. Cl. ..... 430/551; 430/558
[58] Field of Search ..... 430/558, 551

[56] References Cited

U.S. PATENT DOCUMENTS

| | | | |
|---|---|---|---|
| 4,863,840 | 9/1989 | Komorita | 430/505 |
| 4,863,842 | 9/1989 | Kaneko et al. | 430/551 |
| 4,868,100 | 9/1989 | Nishijima | 430/550 |
| 4,880,733 | 11/1989 | Kaneko | 430/551 |
| 4,945,031 | 7/1990 | Sakai et al. | 430/551 |
| 5,017,465 | 5/1991 | Nishijima | 430/551 |

FOREIGN PATENT DOCUMENTS

| | | | |
|---|---|---|---|
| 1267050 | 11/1986 | Japan | 430/558 |
| 2172359 | 7/1987 | Japan | 430/551 |
| 2180366 | 8/1987 | Japan | 430/558 |
| 2180367 | 8/1987 | Japan | 430/558 |

*Primary Examiner*—Lee C. Wright
*Attorney, Agent, or Firm*—Frishauf, Holtz, Goodman & Woodward

[57] ABSTRACT

There is disclosed a light-sensitive silver halide photographic material having at least one light-sensitive emulsion layer and at least one non-light-sensitive emulsion layer of a support, the improvement wherein a coupler represented by the following formula (M−I) and an anti-fading additive having a quenching rate constant of a singlet oxygen of $1\times10^{7}M^{-1}\cdot sec^{-1}$ or more provided that 2,5-dialkylhydroquinones are excluded are contained in at least one layer of the light-sensitive emulsion layer, and a compound represented by the following formula (II) is contained in at least one layer selected from the light-sensitive emulsion layer and the non-light-sensitive emulsion layer.

(M-I)

wherein Z represents a group of non-metallic atoms necessary for forming a nitrogen-containing heterocyclic ring, the ring formed by said Z may have a substitutent(s), X represents hydrogen atom or an eliminatable group by the reaction with an oxidized product of a color developing agent, and R represents hydrogen atom or a substituent, (II)

wherein $R^{12}$ and $R^{13}$ each represent secondary or tertiary alkyl group, provided that total carbon atoms of the alkyl groups represented by $R^{12}$ and $R^{13}$ are 20 or more.

14 Claims, No Drawings

LIGHT-SENSITIVE SILVER HALIDE PHOTOGRAPHIC MATERIAL PREVENTED IN COLOR CONTAMINATION

BACKGROUND OF THE INVENTION

This invention relates to a light-sensitive silver halide photographic material, more specifically to a light-sensitive silver halide photographic material prevented in color contamination.

In a light-sensitive silver halide photographic material (hereinafter merely referred to as "photographic material" or "light-sensitive material"), for the purpose of decreasing sub-absorption at about 430 nm which is not preferred of a dye formed from 5-pyrazolone type magenta coupler conventionally used, many pyrazoloazole type magenta couplers have been developed (U.S. Pat. No. 3,725,067, G.B. Patent No. 1,252,418, Research Disclosures No. 23220, No. 24230, No. 23531 and No. 23626, and Japanese Provisional Patent Publication No. 162548/1984).

Dyes formed from these pyrazoloazole type coupler show extremely less sub-absorption at about 430 nm than those of the dyes formed from 5-pyrazolones as mentioned above, and thus they are preferred in color reproduction and have advantages that occurrence in yellow stain (Y stain) against light, heat and humidity at an uncolored portion is little.

On the other hand, from the commercial demand for quick processing in recent years, many light-sensitive materials have been processed quickly. However, in such a system, image tone is likely contaminated and improvement thereof has been desired. In general, when a hydroquinone compound is used in an intermediate layer, contamination of image tone as mentioned above can be improved.

However, in a system to which the hydroquinone compound is added in an amount which can improve the image tone contamination, there has been found that light resistance is deteriorated. In order to improve these problems, in Japanese Provisional Patent Publications No. 169160/1987, No. 169159/1987 and No. 18475/1988, there have been proposed the methods in which light resistance is improved by changing the kind or an amount of a hydroquinone type color mixing preventive agent. However, according to these techniques, improved effect is insufficient and it is difficult to improve both of the light resistance and color contamination.

Further, in a rapid processing of the pyrazoloazole type coupler as mentioned above, there is a phenomenone that an oil component is oozing from the surface of a sample (hereinafter referred to "perspiration") and it is regarded as questionable.

SUMMARY OF THE INVENTION

An object of the present invention is to overcome the above problems and to provide a light-sensitive silver halide photographic material in which the problem of color contamination can be overcome while maintaining good light resistance possessed by a coupler whereby both of light resistance and color contamination can be improved and further the problem of perspiration can be overcome.

The above object of the present invention can be accomplished by a light-sensitive silver halide photographic material having at least one light-sensitive emulsion layer and at least one non-light-sensitive emulsion layer on a support, the improvement wherein a coupler represented by the following formula (M−I) and an anti-fading additive having a quenching rate constant of a singlet oxygen of $1\times10^{7}M^{-1}\cdot sec^{-1}$ or more (provided that 2,5-dialkylhydroquinones are excluded) are contained in at least one layer of the light-sensitive emulsion layer, and a compound represented by the following formula (II) is contained in at least one layer selected from the light-sensitive emulsion layer and the non-light-sensitive emulsion layer.

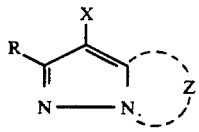

(M-I)

wherein Z represents a group of non-metallic atoms necessary for forming a nitrogen-containing heterocyclic ring, the ring formed by said Z may have a substitutent(s), X represents hydrogen atom or an eliminatable group by the reaction with an oxidized product of a color developing agent, and R represents hydrogen atom or a substituent,

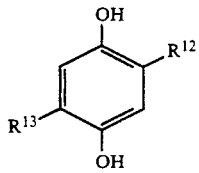

(II)

wherein $R^{12}$ and $R^{13}$ each represent secondary or tertiary alkyl group, provided that total carbon atoms of the alkyl groups represented by $R^{12}$ and $R^{13}$ are 20 or more.

DESCRIPTION OF THE PREFERRED EMBODIMENTS

The present inventors have studied variously about means for improving color contamination and light resistance, and as the results, they have found that by using a specific anti-fading additive and a specific hydroquinone compound, color contamination can be prevented and light resistance can be synergistically improved, and also perspiration can be improved whereby accomplished the present invention. According to the present invention, oozing (perspiration) of an oil component at rapid processing can be improved.

In the following, the present invention will be described in more detail.

First, the coupler represented by the formula (M−I) to be used in the present invention is to be described. Thus coupler functions as a magenta coupler.

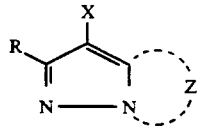

(M-I)

In the formula (M−I), Z represents a group of non-metallic atoms necessary for forming a nitrogen-containing heterocyclic ring, and the ring formed by said Z may have a substituent group.

X represents hydrogen atom or a group which can be eliminated by a reaction with an oxidized product of a color developing agent.

Also, R represents hydrogen atom or a substituent group.

The substituent group represented by R is not particularly limited, but may representatively include each group of alkyl, aryl, anilino, acylamino, sulfonamide, alkylthio, arylthio, alkenyl and cycloalkenyl. Additionally, there may be mentioned a halogen atom, and each group of cycloalkenyl, alkynyl, hetero ring, sulfonyl, sulfinyl, phosphonyl, acyl, carbamoyl, sulfamoyl, cyano, alkoxy, aryloxy, heterocyclicoxy, siloxy, acyloxy, carbamoyloxy, amino, alkylamino, imide, ureido, sulfamoylamino, alkoxycarbonylamino, aryloxycarbonylamino, alkoxycarbonyl, aryloxycarbonyl and heterocyclic thio, and also a spiro-compound residue and a bridged hydrocarbon compound residue.

The alkyl group represented by R are preferably alkyl groups having 1 to 32 carbon atoms, which may be straight or branched.

The aryl group represented by R is preferably a phenyl group.

The acylamino group represented by R may include an alkylcarbonylamino group and an arylcarbonylamino group.

The sulfonamide group represented by R may include, form example, an alkylsulfonylamino group and an arylsulfonylamino group.

The alkyl component and aryl component in the alkylthio group and arylthio group represented by R are each the alkyl group and aryl group represented by the above R.

The alkenyl group represented by R is alkenyl groups having 2 to 32 carbon atoms, and the cycloalkyl group is cycloalkyl groups preferably having 3 to 12 carbon atoms, particularly preferably 5 to 7 carbon atoms. The alkenyl groups may be straight or branched.

The cycloalkenyl group represented by R is cycloalkenyl groups preferably having 3 to 12 carbon atoms, particularly preferably 5 to 7 carbon atoms.

The sulfonyl group represented by R may include an alkylsulfonyl group and an arylsulfonyl group; the sulfinyl group, form example, an alkylsulfinyl group and arylsulfinyl group; the phosphonyl group, form example, an alkylphosphonyl group, an alkoxyphosphonyl group, an aryloxyphosphonyl group and an arylphosphonyl group; the acyl group, form example, an alkylcarbonyl group and an arylcarbonyl group; the carbamoyl group, form example, an alkylcarbamoyl group and an arylcarbamoyl group; the sulfamoyl group, form example, an alkylsulfamoyl group and an arylsulfamoyl group; the acyloxy group, form example, an alkylcarbonyloxy group and an arylcarbonyloxy group; the carbamoyloxy group, form example, an alkylcarbamoyloxy group and an arylcarbamoyloxy group; the ureido group, form example, an alkylureido group and an arylureido group; the sulfamoylamino group, form example, an alkylsulfamoylamino group and an arylsulfamoylamino group; the heterocyclic group, preferably 5- to 7-membered cyclic groups, specifically including a 2-furyl group, a 2-thienyl group, a 2-pyrimidinyl group and a 2-benzothiazolyl group; the heterocyclic oxy group, preferably groups having 5- to 7-membered heterocyclic rings, specifically including a 3,4,5,6-tetrahydropyranyl-2-oxy group, a 1-phenyltetrazole-5-oxy group; the heterocyclic thio group, preferably 5- to 7-membered heterocyclic thio groups, form example, a 2-pyridylthio group, a 2-benzothiazolylthio group, a 2,4-diphenoxy-1,3,5-triazole-6-thio group; the siloxy group, a triethylsiloxy group, a triethylsiloxy group and a dimethylbutylsiloxy group; the imide group, a succinimide group, a 3-heptadecyl succinimide group, a phthalimide group and a glutarimide group; the spiro-compound residue, spiro[3,3]heptan-1-yl; the bridged hydrocarbon compound residue, bicyclo[2.2.1]heptan-1-yl, tricyclo[3.3.1.1$^{3,7}$]-decan-1-yl and 7,7-dimethylbicyclo[2.2.1]heptan-1-yl.

The group represented by X, which can be eliminated by reaction with an oxidized product of a color developing agent, may include, form example, a halogen atom (a chlorine atom, a bromine atom and a fluorine atom), and each group of alkoxy, aryloxy, heterocyclic oxy, acyloxy, sulfonyloxy, alkoxycarbonyloxy, aryloxycarbonyl, alkyloxyalyloxy, alkoxyoxalyloxy, alkylthio, arylthio, heterocyclic thio, alkyloxycarbonylthio, acylamino, sulfonamide, nitrogen-containing hetero ring which is bonded by N atom, alkyloxycarbonylamino, aryloxycarbonylamino, carboxyl, and

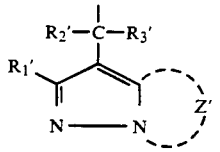

wherein $R_{1'}$ has the same meaning as the above R; Z' has the same meaning as the above Z; and $R_{2'}$ and $R_{3'}$ each represent a hydrogen atom, an aryl group, an alkyl group or a heterocyclic ring, preferably a halogen atom, particularly preferably a chlorine atom.

Further, the nitrogen-containing hetero ring formed by Z or Z' may include, form example, a pyrazole ring, an imidazole ring, a triazole ring or a tetrazole ring, and as a substituent group which may be possessed by the above rings, there may be mentioned those in the description of the above R.

Those represented by the formula (M−I) are further specifically represented by, form example, the following formulae (M−II) to (M−VII).

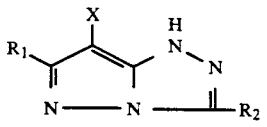

(M-II)

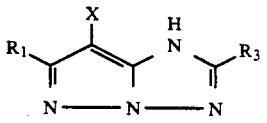

(M-III)

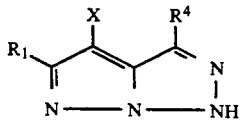

(M-IV)

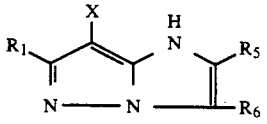

(M-V)

-continued

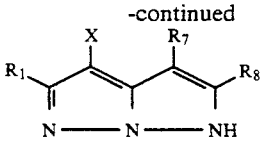

(M-VI)

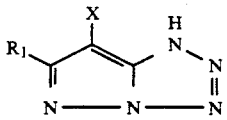

(M-VII)

In the above formulae (M−II) to (M−VII), $R_1$ to $R_8$ and X each have the same meaning as the above R and X, respectively.

Among the couplers represented by the formula (M−I), preferred is that represented by the following formula (M−VIII).

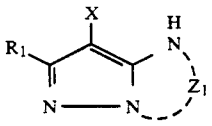

(M-VIII)

wherein $R_1$, X and $Z_1$ each have the same meanings as $R_1$, X and Z in the formula (M−I), respectively.

Among the magenta couplers represented by the above formulae (M−II) to (M−VII), particularly preferred is the magenta coupler represented by the formula (M−II).

Most preferred substituent groups R and $R_1$ on the above heterocyclic ring are that represented by the following formula (M−IX).

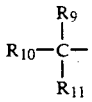

(M-IX)

wherein $R_9$, $R_{10}$ and $R_{11}$ each have the same meaning of the above R.

Two of $R_9$, $R_{10}$ and $R_{11}$, form example, $R_9$ and $R_{10}$ may be bonded to form a saturated or unsaturated ring (e.g. cycloalkane, cycloalkene and hetero ring), and further, $R_{11}$ may be bonded to said ring to constitute a bridged hydrocarbon compound residue.

Among those represented by the formula (M−X), preferred are the case (i) where at least two of $R_9$ to $R_{11}$ are alkyl groups, and the case (ii) where one of $R_9$ to $R_{11}$, form example, $R_{11}$ is a hydrogen atom, and the other two of $R_9$ and $R_{10}$ are bonded to form cycloalkyl together with a root carbon atom.

In the case (i), preferred is the case where two of $R_9$ to $R_{11}$ are alkyl groups, and the other one is a hydrogen atom or an alkyl group.

The substituent groups which may be possessed by the ring formed by Z in the formula (M−I) and the ring formed by $Z_1$ in the formula (M−VIII), and $R_2$ to $R_8$ in the formulae (M−II) to (M−VI) are preferably those represented by the following formula (M−X).

$$-R^1-SO_2-R^2 \qquad \text{(M-X)}$$

wherein $R^1$ represents an alkylene group; and $R^2$ represents an alkyl group, a cycloalkyl group or an aryl group.

The alkylene group represented by the above $R^1$ may have preferably 2 or more, more preferably 3 to 6 carbon atoms in its straight portion, and may be either straight or branched.

The cycloalkyl group represented by the above $R^2$ is preferably 5- or 6-membered.

In the following, representative specific examples of the compound represented by the formula (M−I) are shown.

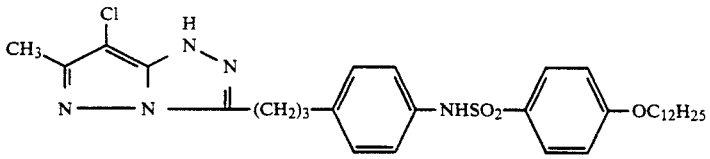

1

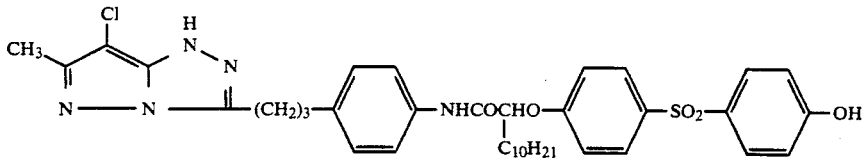

2

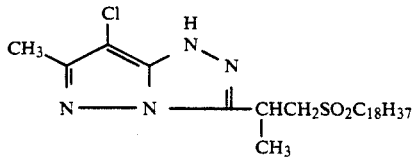

3

-continued
4
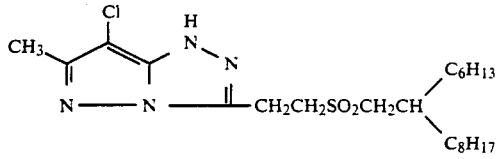
5
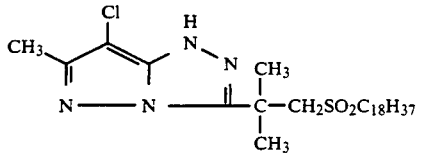
6
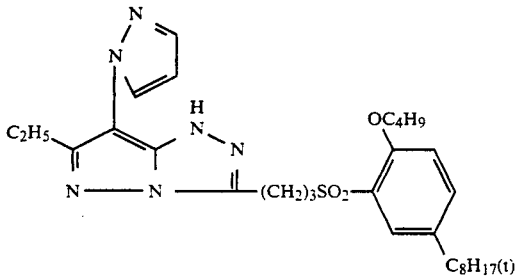
7
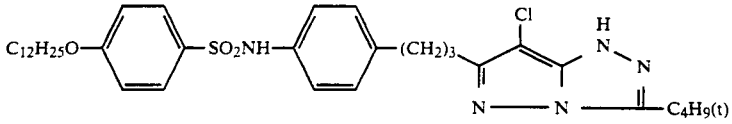
8
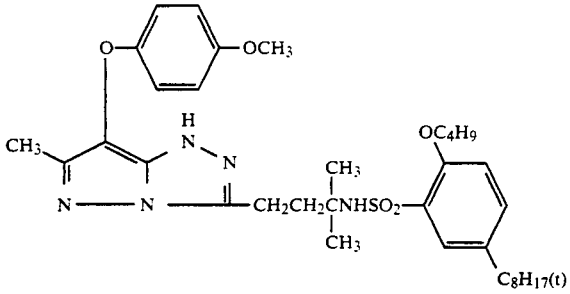
9
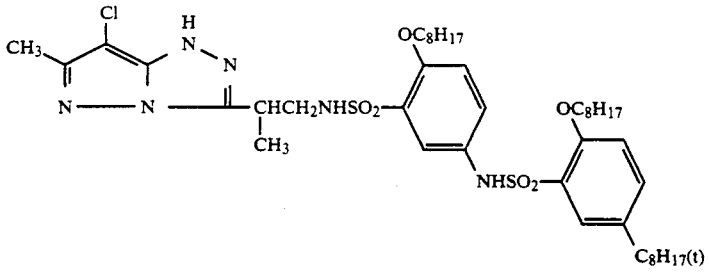
10
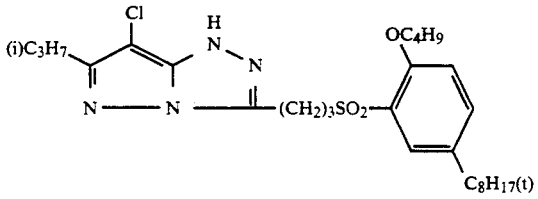

-continued
11
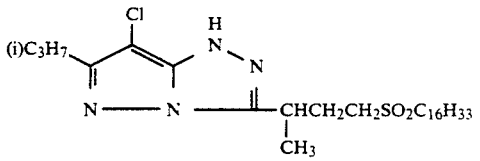
12
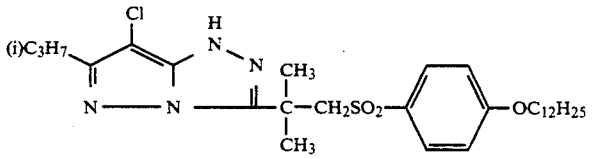
13
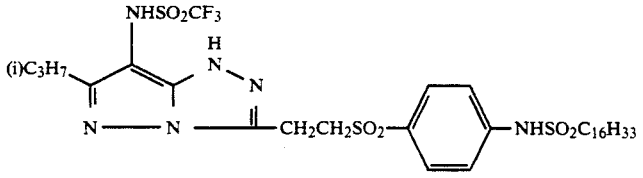
14
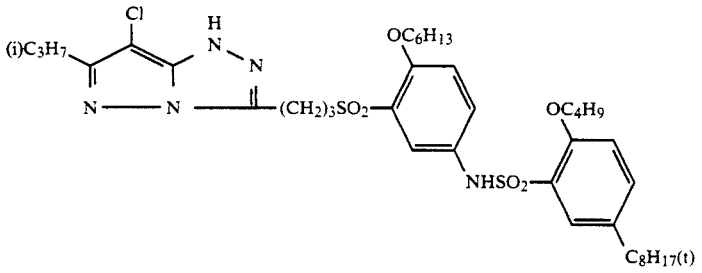
15
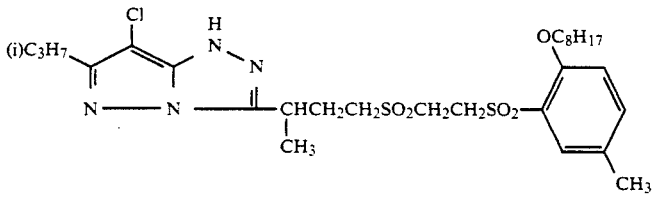
16
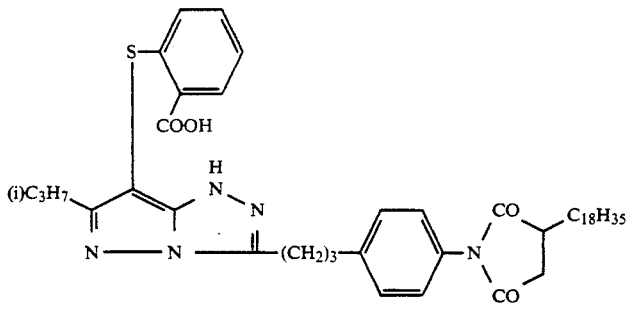
17
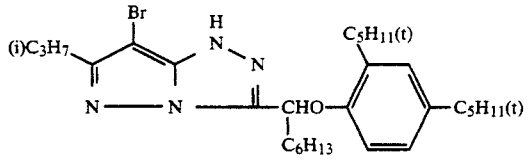
18
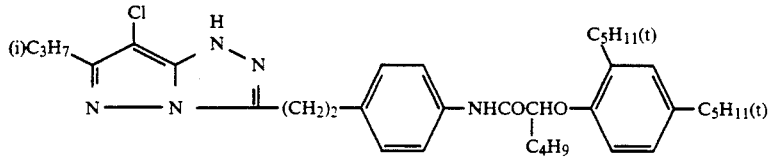

-continued
19
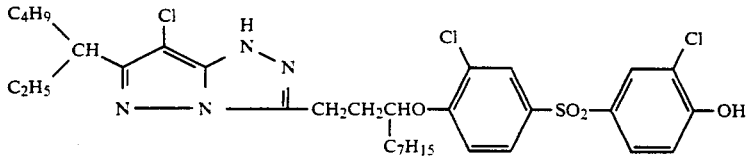
20
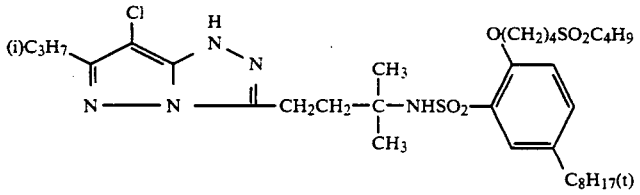
21
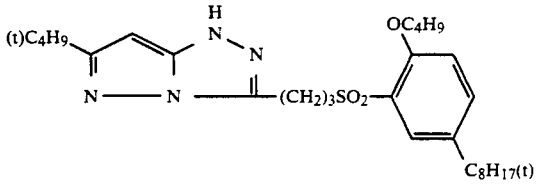
22
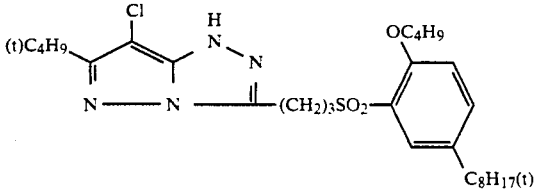
23
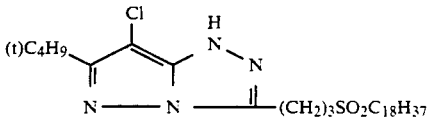
24
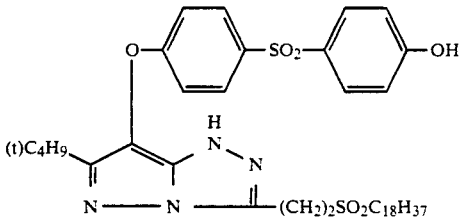
25
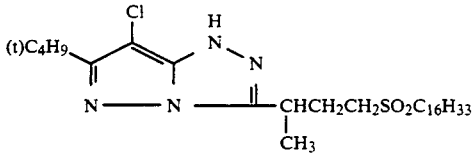
26
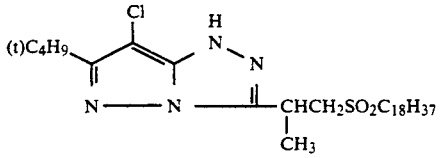
27
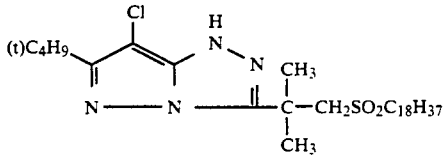

-continued
28
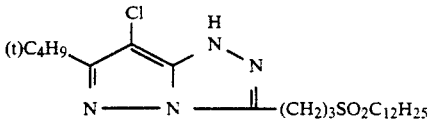
29
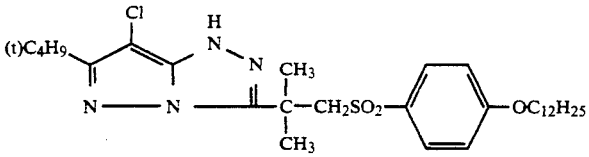
30
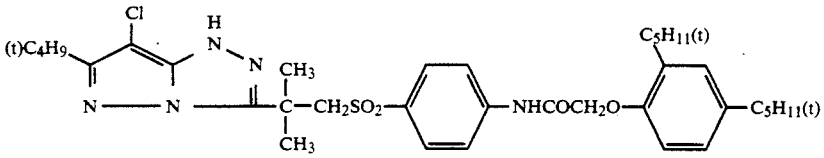
31
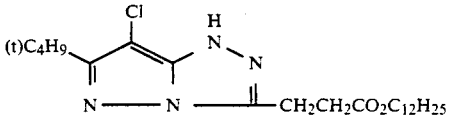
32
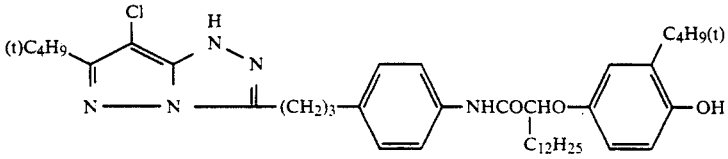
33
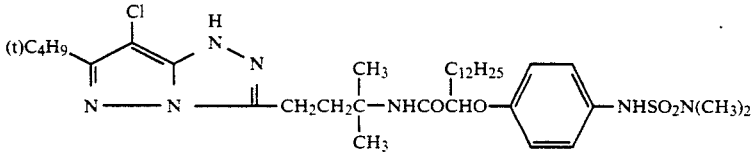
34
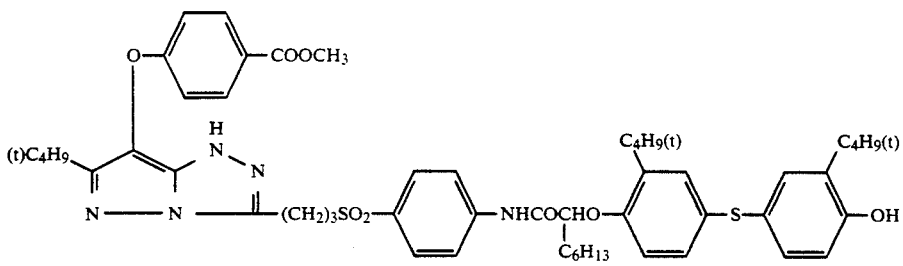
35
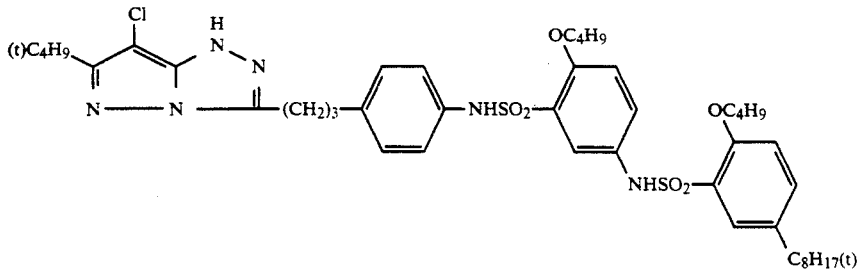

-continued
36
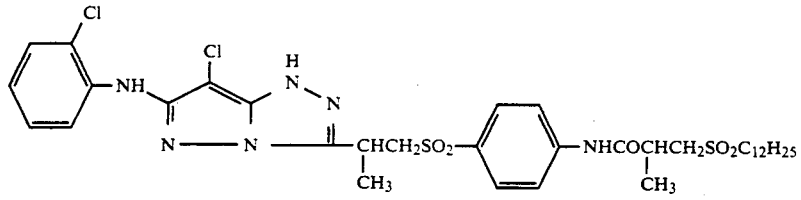
37
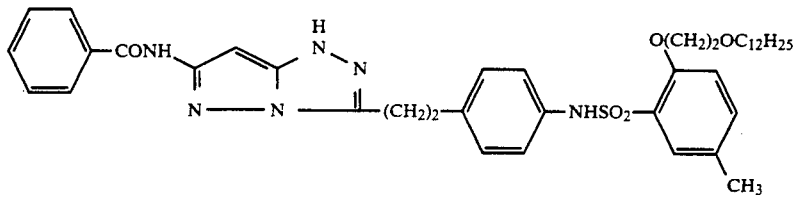
38
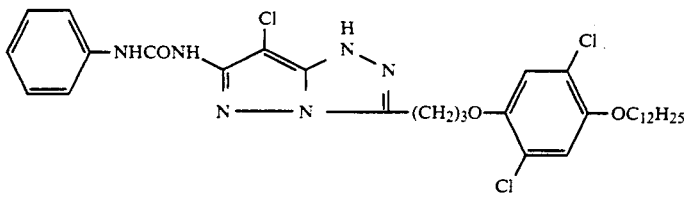
39
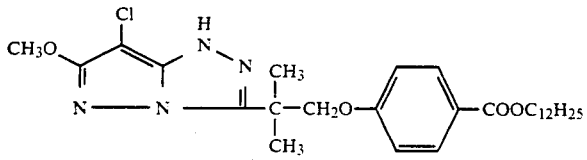
40
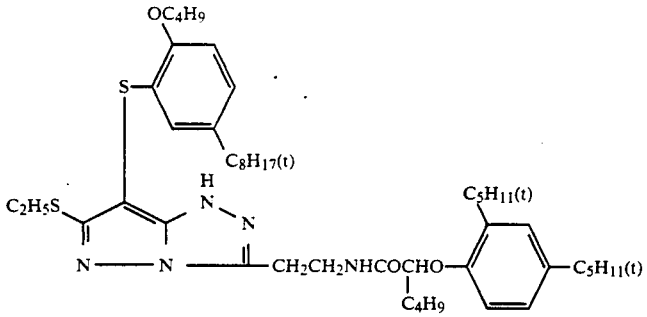
41
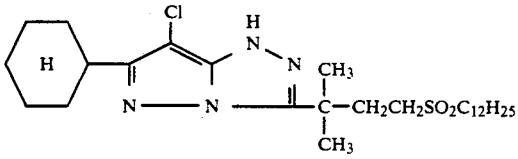
42
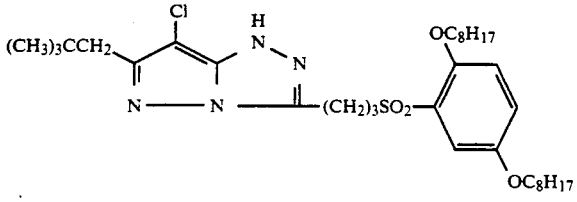

-continued
43
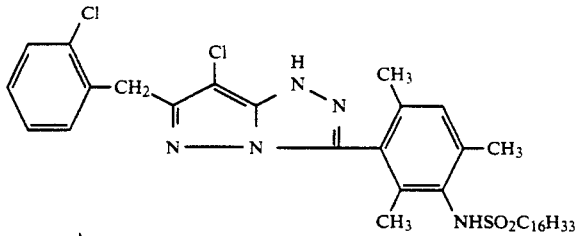
44
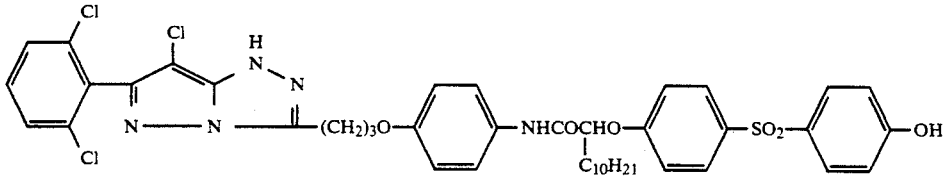
45
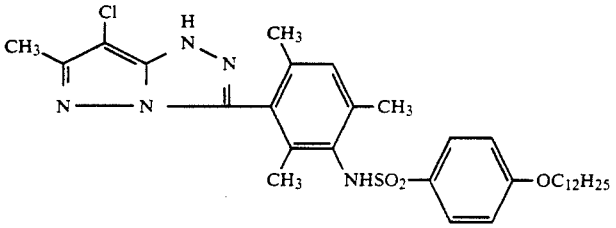
46
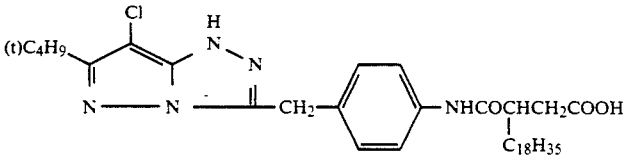
47
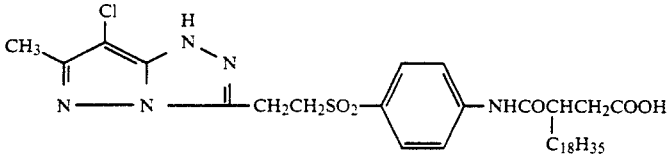
48
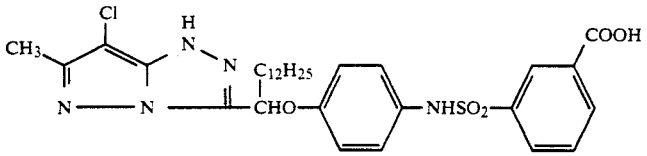
49
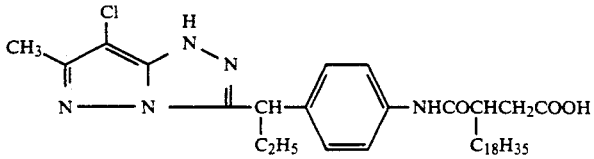
50
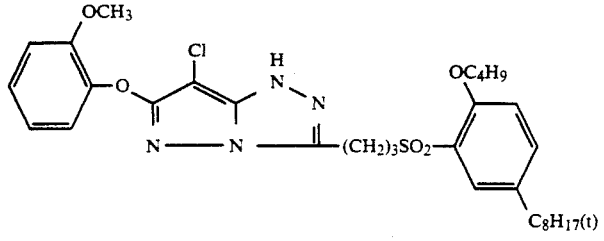

-continued
51
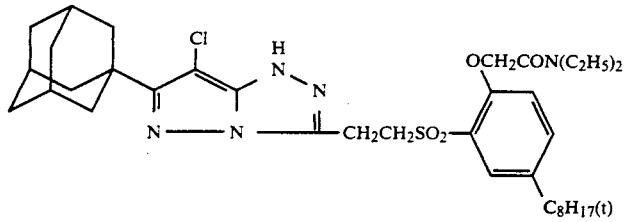
52
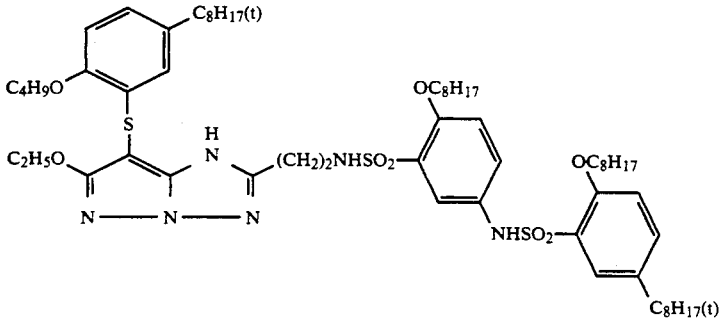
53
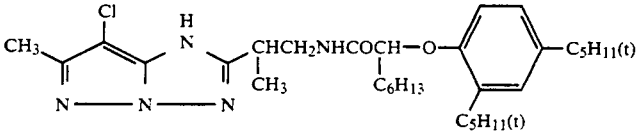
54
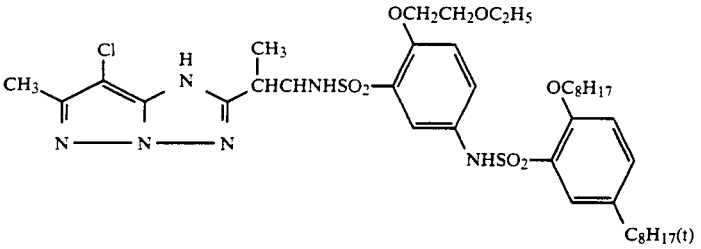
55
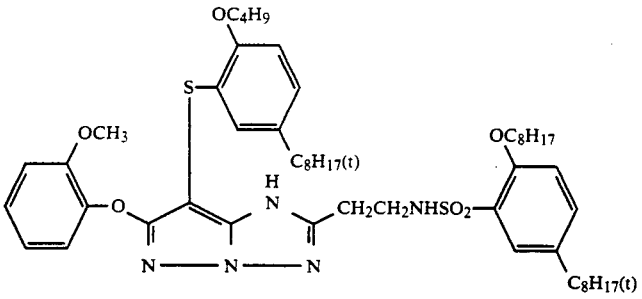
56
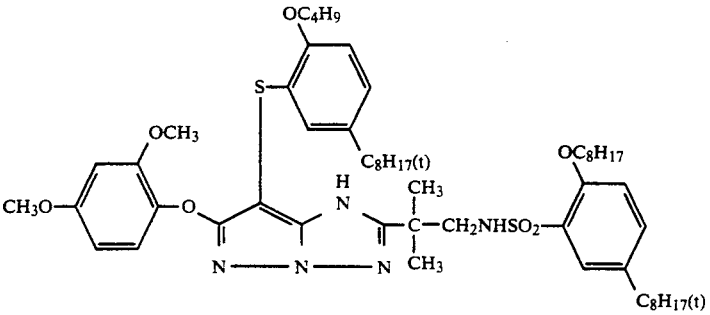

-continued
57
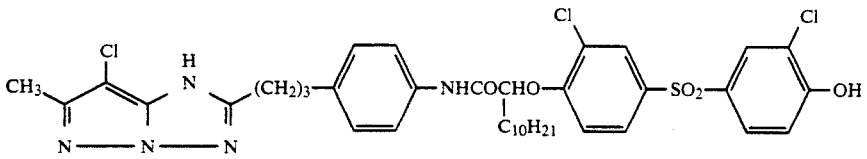
58
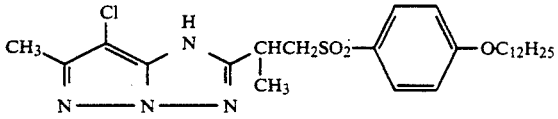
59
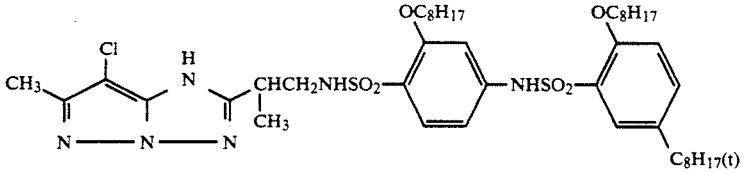
60
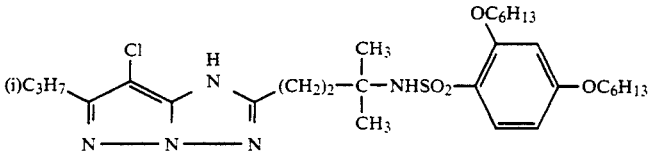
61
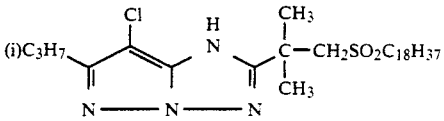
62
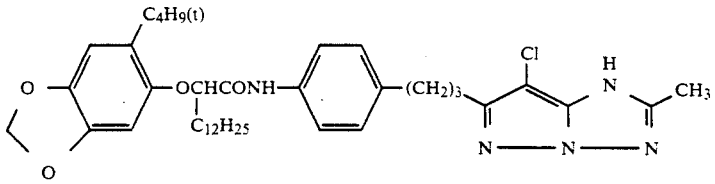
63
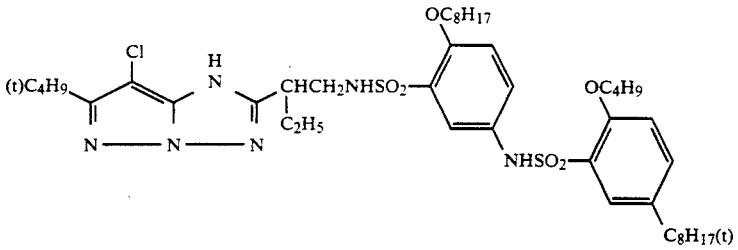
64
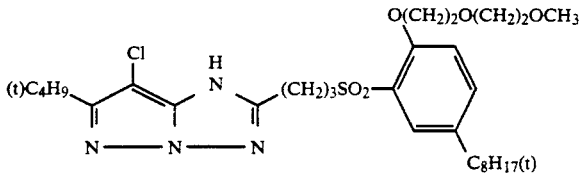
65
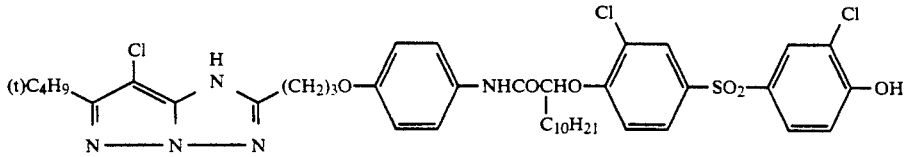

-continued
66
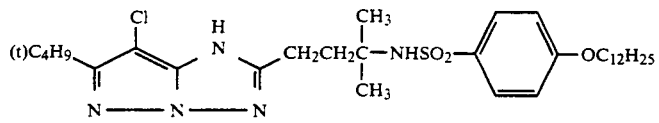
67
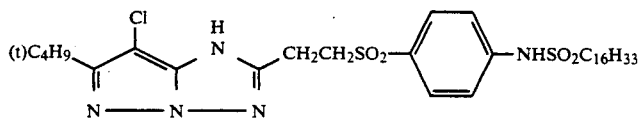
68
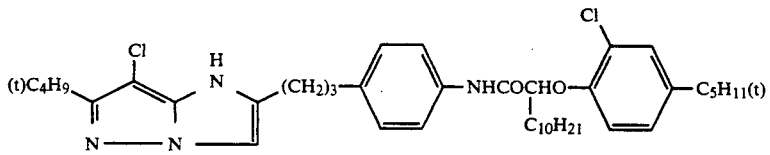
69
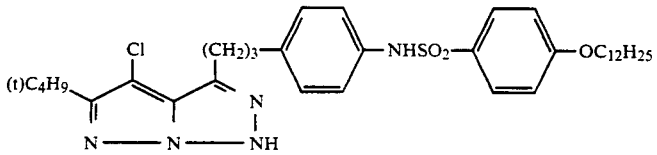
70
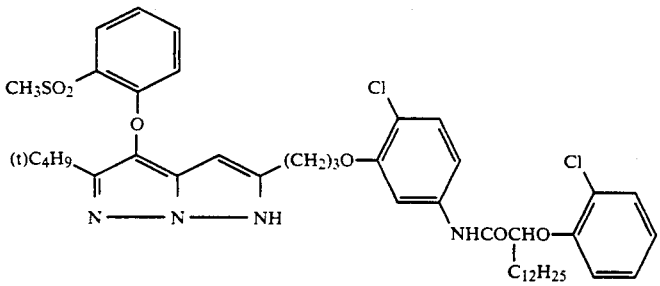
71
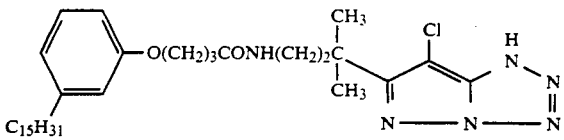
72
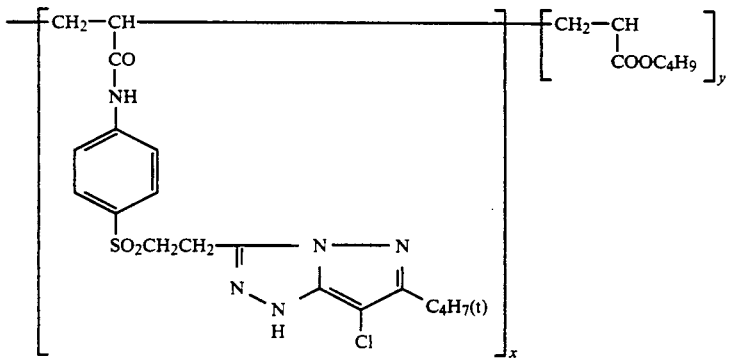
x:y = 50:50

-continued

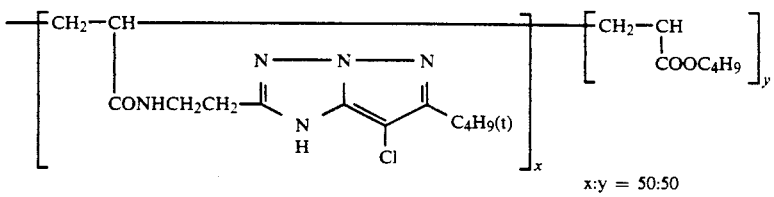

73 x:y = 50:50

As a specific example of the compound represented by the formula (M−I), in addition to the representative specific examples shown above, there may be mentioned compounds Nos. 1 to 4, Nos. 8 to 17, Nos. 14 to 24, Nos. 26 to 43, Nos. 45 to 59, Nos. 61 to 104, Nos. 106 to 121, Nos. 123 to 162 and Nos. 164 to 223 among the compounds described on p. 18 to p. 32 of Japanese Provisional Patent Publication No. 166339/1987.

The above couplers can be synthesized by referring to Journal of the Chemical Society, Perkin I (1977), pp. 2047 to 2052, U.S. Pat. No. 3,725,067, and Japanese Unexamined Patent Publications No. 99437/1984, No. 42045/1984, No. 162548/1984, No. 171956/1984, No. 33552/1985, No. 43659/1985, No. 172982/1985, No. 43659/1985, No. 172982/1985, No. 190779/1985, 209457/1987 and No. 307453/1988.

The magenta coupler represented by the formula (M−I) is used generally in an amount of $1\times10^{-3}$ mole to 1 mole, preferably in the range of $1\times10^{-2}$ mole to $8\times10^{-1}$ mole per mole of silver halide.

Further, the coupler represented by the formula (M−I) can be used in combination with other kinds of magenta dye-forming couplers.

Next, the compound of the formula (II) will be described in detail.

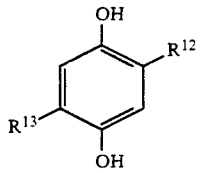

(II)

In the formula (II), $R^{12}$ and $R^{13}$ each represent a secondary or tertiary alkyl group, provided that the total carbon atoms of the alkyl groups represented by $R^{12}$ and $R^{13}$ are 20 or more.

As the alkyl group represented by $R^{12}$ or $R^{13}$, there may be mentioned, for example, sec-decyl group, sec-docecyl group, sec-tetradecyl group, sec-pentadecyl group, sec-hexadecyl group, sec-octadecyl group, sec-eicosyl group, sec-triacontyl group, t-decyl group, t-dodecyl group, t-tetradecyl group, t-hexadeycl group, t-octadecyl group and t-eicosyl group.

The compound represented by the formula (II) is a dialkylhydroquinone and representative specific examples are summarized below, but the compounds which can be used in the present invention are not limited by these examples.

The compound represented by the formula may be added in any layer of a light-sensitive material, but preferably in a non-light-sensitive layer adjacent to a layer containing the magenta coupler, more preferably in a layer close to a support and adjacent to a layer containing an aimed magenta coupler.

These compounds may be generally added in an amount of 0.01 to 0.5 g/m² per one layer.

Also, a corresponding quinone derivative of the compound represented by the formula (II) may be, of course, used in combination.

As the method for adding the above quinone compound, there may be naturally formed by an air oxidation of the compound represented by the formula (II) or separately synthesized quinone compound may be added.

In the following, specific examples of the compound represented by the formula (II) are shown.

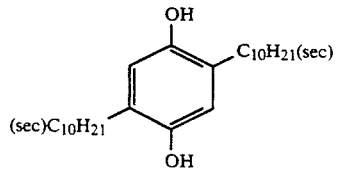

II-1

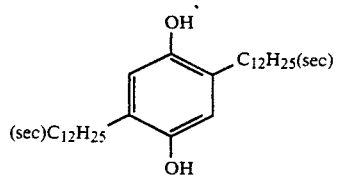

II-2

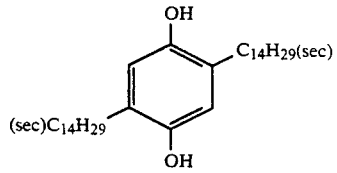

II-3

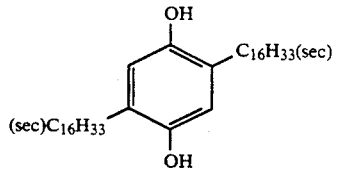

II-4

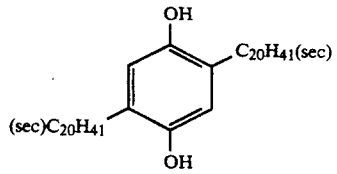

II-5

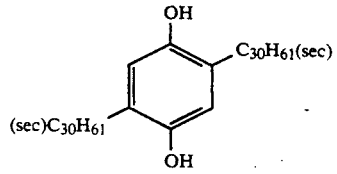

II-6

-continued

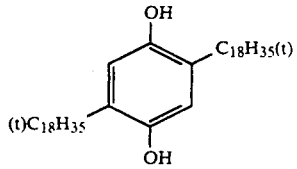

II-7

Reaction product of mixed $C_{12}$ to $C_{14}$ α-olefins and hydroquinone II-8

Reaction product of mixed $C_{12}$ to $C_{18}$ α-olefins and hydroquinone II-9

Reaction product of mixed $C_{16}$ to $C_{18}$ α-olefins and hydroquinone II-10

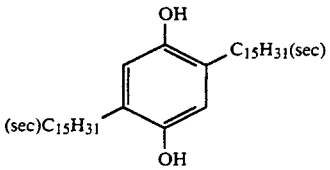

II-11

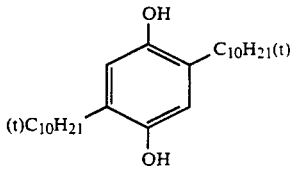

II-12

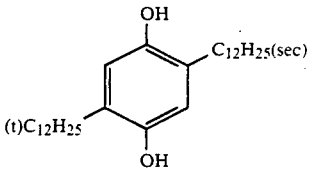

II-13

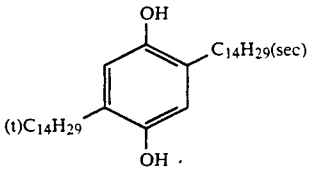

II-14

Next, the anti-fading additive to be used in at least one layer of the light-sensitive emulsion layer of the light-sensitive material according to the present invention will be described.

The anti-fading additive to be used in the present invention is a compound having a quenching rate constant of a singlet oxygen is $1\times10^7M^{-1}\cdot sec^{-1}$ or more, preferably $2.5\times10^7M^{-1}\cdot sec^{-1}$ or more, more preferably $3\times10^7M^{-1}\cdot sec^{-1}$ or more. Provided that 2,5-dialkylhydroquinone compound (this is shown by the formula (III)) is excluded.

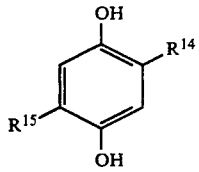

(III)

wherein $R^{14}$ and $R^{15}$ each represent an alkyl group.

As the alkyl group represented by $R^{14}$ and $R^{15}$, there may be mentioned, for example, t-octyl group and t-butyl group.

The above quenching rate constant of the singlet oxygen can be determined by the method of measuring light fading of rubrene disclosed in, for example, Journal of Physical Chemistry, vol. 83, p. 591 (1979).

That is, to a chloroform solution of rubrene and a chloroform solution containing rubrene and a compound to be tested was irradiated a light with an equal energy.

At this time, an initial concentration of rubrene is made [R], a concentration of the compound to be tested is made [Q], a concentration of rubrene of the rubrene alone solution after testing is made $[R]_{F0}$, and a concentration of rubrene of the mixed solution of rubrene and the compound to be tested after testing is made $[R]_{FQ}$, the quenching rate constant (kq) of the singlet oxygen can be calculated by the equation:

$$kq = \frac{5.3\times10^7([R]_{FQ}-[R]_{F0})+1.7\times10^4\ln([R]_{FQ}/[R]_{F0})}{[Q]\ln([R]/[R]_{FQ})}$$

As the anti fading additive to be used in the present invention, there may be mentioned, for example, compounds represented by the formulae (A), (B) and (C), but the present invention is not limited by these.

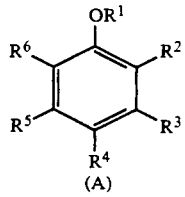

(A)

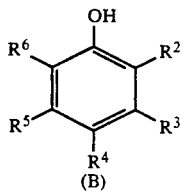

(B)

wherein $R^1$ represents an alkyl group or a trialkylsilyl group; $R^2$, $R^3$, $R^4$, $R^5$ and $R^6$ each represent hydrogen atom, an alkyl group, an alkoxy group, an aryl group, an aryloxy group, an alkenyl group, an alkenyloxy group, an acylamino group, a halogen atom, an alkylthio group, an arylthio group, an alkoxycarbonyl group, an acyloxy group, an acyl group or a sulfonamide group; either two of $R^1$ to $R^6$ may form a 5- or 6-membered ring; provided that both of $R^2$ and $R^6$ in formula (B) are alkyl groups is excluded and $R^4$ cannot be hydroxyl group.

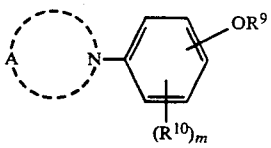

(C)

wherein $R^9$ represents an alkyl group, a cycloalkyl group, an alkenyl group, an aryl group, a heterocyclic group, an acyl group, a bridged hydrocarbon group, an alkylsulfonyl group or an arylsulfonyl group, $R^{10}$ represents a group which can be substituted on a benzene ring; m is an integer of 0 to 4; when m is 2 or more, plural number of $R^{10}$s may be the same or different and may form a ring with $R^{10}$s, or $R^{10}$ and $-OR^9$ may be combined to form a ring; and A represents a group of non-metallic atoms necessary for forming a 5- to 8-membered ring.

The anti-fading additive to be preferably used in the present invention is a compound represented by the following formula (D):

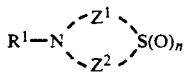

(D)

wherein $R^1$ represents an aryl group or a heterocyclic group; $Z^1$ and $Z^2$ each represent an alkylene group having 1 to 3 carbon atoms, provided that the total carbon atoms of the alkylene group represented by $Z^1$ and $Z^2$ are 3 to 6; and n is an integer of 1 or 2.

Of the compounds represented by the formula (D), particularly preferred compounds are those having a molecular weight (Mn) of 300 or more, more preferably 400 or more.

Next, examples of the anti-fading additives to be used in the present invention are shown below, but the present invention is not limited by these.

1

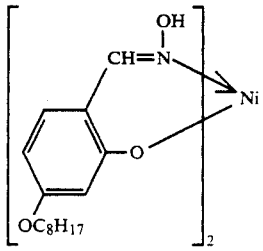

2

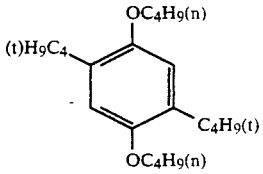

3

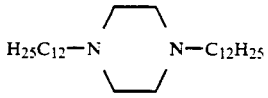

4

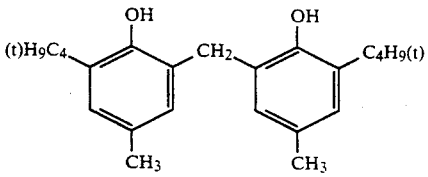

5

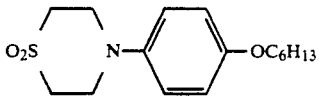

6

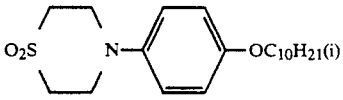

7

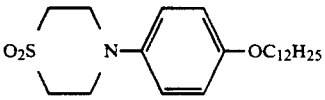

8

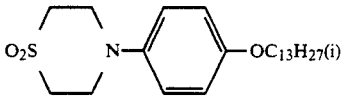

-continued

9

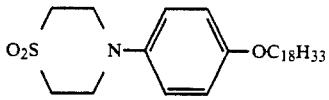

10

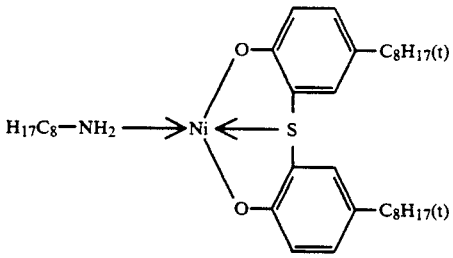

11

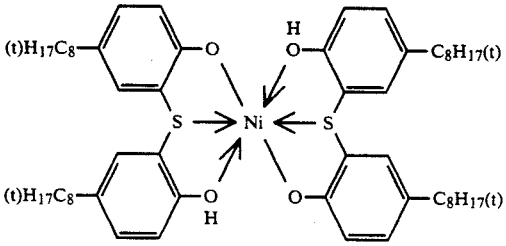

12

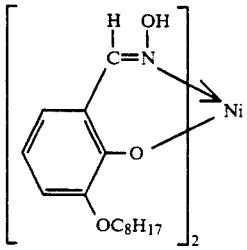

13

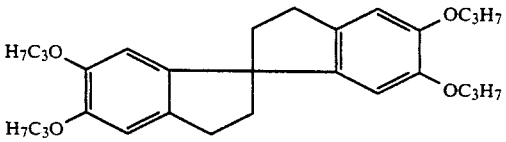

The anti-fading additive to be used in the present invention is a compound having a quenching rate constant of a singlet oxygen is $1\times10^7 M^{-1}\cdot sec^{-1}$ or more, more preferably $2.5\times10^7 M^{-1}\cdot sec^{-1}$ or more.

In dispersed oil drops containing the magenta coupler and the anti-fading additive according to the present invention, a high boiling point organic solvent having a dielectric constant (at 25° C.) of 6.0 or more is preferably contained.

EXAMPLES

In the following, examples of the present invention are shown but the present invention is not limited by these.

EXAMPLE 1

A paper support wherein a polyethylene is coated on one surfaces thereof and a polyethylene containing titanium oxide was coated on the other surface as a first layer was prepared. On this laminated support were coated the following layers having the compositions shown below to prepare a light-sensitive silver halide color photographic sample No. 101. The coating solutions were prepared as shown below, respectively.

First Layer Coating Solution

To a mixture of 26.7 g of a yellow coupler (Y−6), 10.0 g of a dye image stabilizer (ST−1),6.67 g of a dye image stabilizer (ST−2) and 6.67 g of a high boiling point solvent (DNP) was added 60 ml of ethyl acetate to dissolve them. This solution was emulsified and dispersed in 220 ml of a 10% gelatin aqueous solution containing 7 ml of a 20% surfactant (SU - 1) by using a ultrasonic wave homogenizer to obtain a yellow coupler dispersion. This dispersion was mixed with a blue-sensitive silver halide emulsion (containing 9.23 g of silver) prepared according to the following conditions to prepare a first layer coating solution.

A second to seventh layer coating solutions are also prepared in the same manner as in the above first layer coating solution.

Compositions of the respective layers are shown below (an amount is shown in terms of g/m$^2$).

| | |
|---|---|
| Seventh layer (Protective layer) | |
| Gelatin | 1.0 |
| Sixth layer (UV-ray absorbing layer) | |
| Gelatin | 0.4 |
| UV-ray absorber (UV-1) | 0.10 |
| UV-ray absorber (UV-2) | 0.04 |
| UV-ray absorber (UV-3) | 0.16 |
| Stain preventive (HQ-1) | 0.01 |
| DNP | 0.2 |
| PVP | 0.03 |
| Irradiation preventive dye (AI-2) | 0.02 |
| Oil-soluble dye | minute amount |
| Fifth layer (Red-sensitive layer) | |
| Gelatin | 1.30 |
| Red-sensitive silver chlorobromide emulsion (Em C): in terms of silver | 0.21 |

-continued

| | |
|---|---|
| Cyan coupler (C-1-4) | 0.17 |
| Cyan coupler (C-2-1) | 0.25 |
| Dye image stabilizer (ST-1) | 0.20 |
| Stain preventive (HQ-1) | 0.01 |
| HBS-1 | 0.20 |
| DOP | 0.20 |
| Fourth layer (UV-ray absorbing layer) | |
| Gelatin | 0.94 |
| UV-ray absorber (UV-1) | 0.28 |
| UV-ray absorber (UV-2) | 0.09 |
| UV-ray absorber (UV-3) | 0.38 |
| Stain preventive (HQ-2) | 0.03 |
| Oil-soluble dye | minute amount |
| DNP | 0.40 |
| Third layer (Green-sensitive layer) | |
| Gelatin | 1.40 |
| Green-sensitive silver chlorobromide emulsion (Em B): in terms of silver | 0.17 |
| Magenta coupler (M-23) | 0.35 |
| Comparative compound-1 | 0.40 |
| DIDP | 0.20 |
| Irradiation preventive dye (AI-1) | 0.01 |
| Second layer (intermediate layer) | |
| Gelatin | 1.20 |
| Stain preventive (HQ-2) | 0.12 |
| DIDP | 0.15 |
| First layer (Blue-sensitive layer) | |
| Gelatin | 1.20 |
| Blue-sensitive silver chlorobromide emulsion (Em A): in terms of silver | 0.26 |
| Yellow coupler (Y-6) | 0.80 |
| Dye image stabilizer (ST-1) | 0.30 |
| Dye image stabilizer (ST-2) | 0.20 |
| Stain preventive (HQ-1) | 0.02 |
| Irradiation preventive dye (AI-3) | 0.01 |
| DNP | 0.20 |

Support

A polyethylene laminated paper containing titanium oxide and a colorant at the light-sensitive layer side

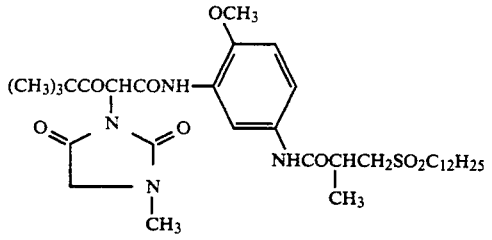

Y-6

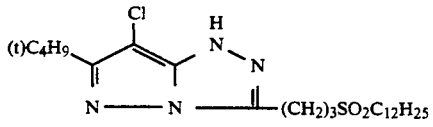

M-23

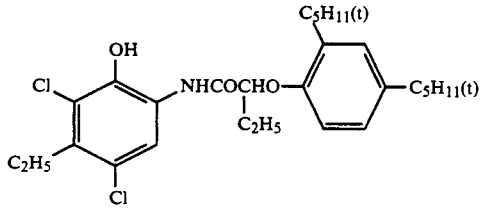

C-1-4

-continued
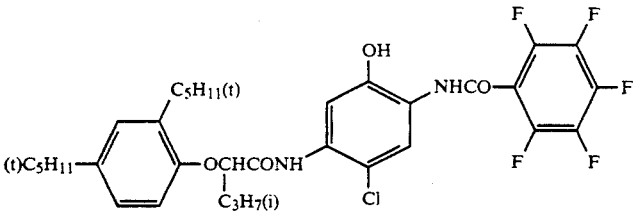
C-2-1
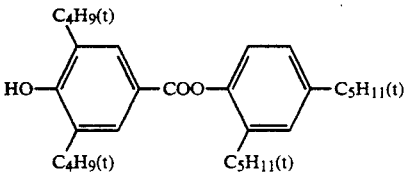
ST-1
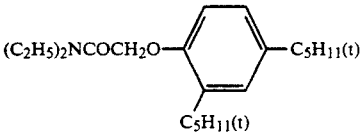
ST-2
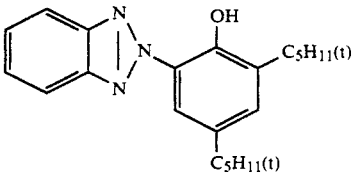
UV-1
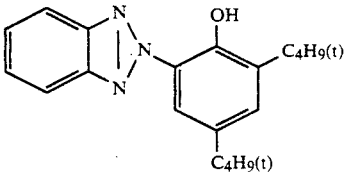
UV-2
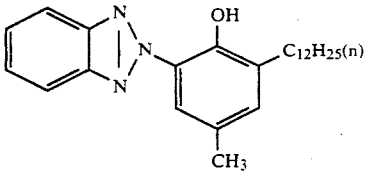
UV-3
| | |
|---|---|
| Dioctylphthalate | DOP |
| Dinonylphthalate | DNP |
| Diisodecylphthalate | DIDP |
| Polyvinylpyrolidone | PVP |
HBS-1
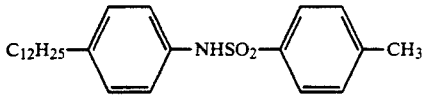
HQ-1
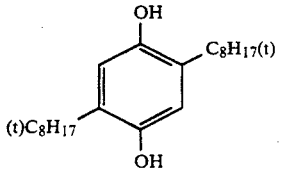

-continued

HQ-2

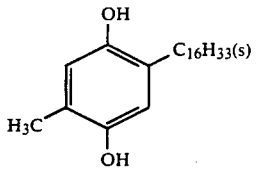

SU-1

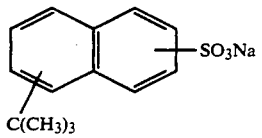

AI-1

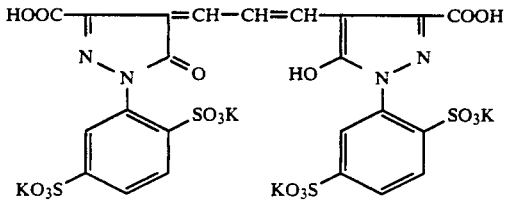

AI-2

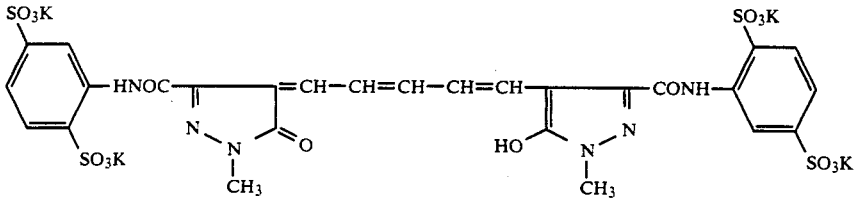

AI-3

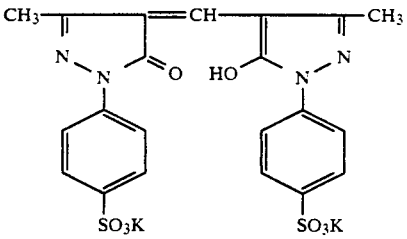

As a hardener, H - 1 shown below as used.

H-1

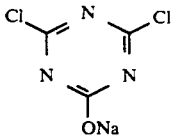

Preparation Method of Blue-Sensitive Silver Halide Emulsion

To 1000 ml of a 2% gelatin aqueous solution maintained at 40° C. were simultaneously added the following (Solution A) and (Solution B) for 30 minutes while controlling a pAg=6.5 and a pH=3.0, and then, the following (Solution C) and (Solution D) were simultaneously added thereto for 180 minutes while controlling a pAg=7.3 and a pH=5.5.

Control of the pAg at this time is carried out according to the method as described in Japanese Provisional Patent Publication No. 45437/1984 and control of the pH was carried out by using an aqueous solution of sulfuric acid or sodium hydroxide.

Solution A

| (Solution A) | |
|---|---|
| Sodium chloride | 3.42 g |
| Potassium bromide | 0.03 g |
| Made up to 200 ml by addition of water. | |

Made up to 200 ml by addition of water.

Solution B

| (Solution B) | |
|---|---|
| Silver nitrate | 10 mg |
| Made up to 200 ml by addition of water. | |

Made up to 200 ml by addition of water.

Solution C

| (Solution C) | |
|---|---|
| Sodium chloride | 102.7 g |
| Potassium bromide | 1.0 g |

-continued

| (Solution C) |
|---|
| Made up to 600 ml by addition of water. |

Made up to 600 ml by addition of water.

Solution D

| (Solution D) | |
|---|---|
| Silver nitrate | 300 g |
| Made up to 600 ml by addition of water. | |

Made up to 600 ml by addition of water.

After completion of the addition, desalting was carried out by using a 5% aqueous solution of Demol N (trade name, available from Kao Atlas Co.) and a 20% magnesium sulfate aqueous solution, and then mixing the resulting material with a gelatin aqueous solution of obtain a monodispersed cubic emulsion EMP - 1 having an average grain size of 0.85 μm, a variation coefficient $(\sigma/r)=0.07$ and a silver chloride content of 99.5 mole %.

The above emulsion EMP - 1 was subjected to chemical ripening at 50° C. for 90 minutes by using the following compounds to obtain a blue-sensitive silver halide emulsion (Em A).

| | |
|---|---|
| Sodium thiosulfate | 0.8 mg/mole AgX |
| Chloroauric acid | 0.5 mg/mole AgX |
| Stabilizer SB-5 | $6 \times 10^{-4}$ mole/mole AgX |
| Sensitizing dye D-1 | $5 \times 10^{-4}$ mole/mole AgX |

Preparation Method of Green-Sensitive Silver Halide Emulsion

In the same manner as in the preparation of EMP - 1 except for changing addition times of (Solution A) and (Solution B), and (Solution C) and (Solution D), a monodispersed cubic emulsion EMP - 2 having an average grain size of 0.43 μm, a variation coefficient $(\sigma/r)=0.08$ and a silver chloride content of 99.5 mole % was obtained.

The above emulsion EMP - 2 was subjected to chemical ripening at 55° C. for 120 minutes by using the following compounds to obtain a green-sensitive silver halide emulsion (Em B).

| | |
|---|---|
| Sodium thiosulfate | 1.5 mg/mole AgX |
| Chloroauric acid | 1.0 mg/mole AgX |
| Stabilizer SB-5 | $6 \times 10^{-4}$ mole/mole AgX |
| Sensitizing dye D-2 | $4 \times 10^{-4}$ mole/mole AgX |

Preparation Method of Red-Sensitive Silver Halide Emulsion

In the same manner as in the preparation of EMP - 1 except for changing addition times of (Solution A) and (Solution B), and (Solution C) and (Solution D), a monodispersed cubic emulsion EMP - 3 having an average grain size of 0.50 μm, a variation coefficient $(\sigma/r)=0.08$ and a silver chloride content of 99.5 mole % was obtained.

The above emulsion EMP - 3 was subjected to chemical ripening at 60° C. for 90 minutes by using the following compounds to obtain a green-sensitive silver halide emulsion (Em C).

| | |
|---|---|
| Sodium thiosulfate | 1.8 mg/mole AgX |
| Chloroauric acid | 2.0 mg/mole AgX |
| Stabilizer SB - 5 | $6 \times 10^{-4}$ mole/mole AgX |
| Sensitizing dye D - 3 | $8.0 \times 10^{-4}$ mole/mole AgX |

D-1

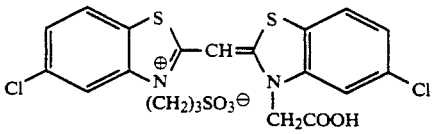

D-2

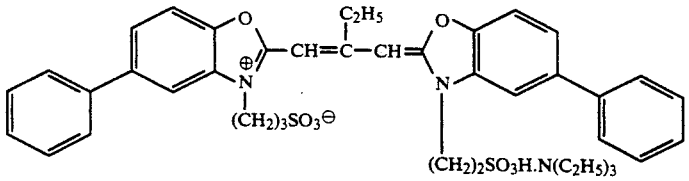

D-3

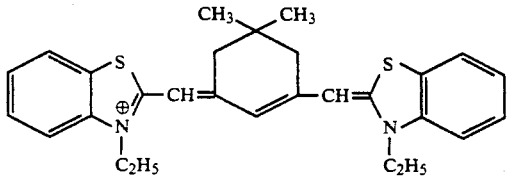

-continued

SB-5

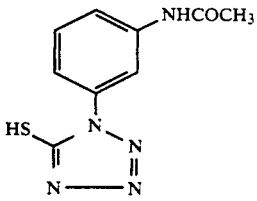

In the same manner as mentioned above, samples for comparative purpose and of the present invention were prepared except for changing the magenta coupler anti-fading additive and the compound represented by the formula (II) added in the second layer and the fourth layer as shown in Table 1.

These samples were exposed to green light according to the conventional method and then processed according to the following processing steps.

| (Processing steps) | Temperature | Time |
|---|---|---|
| Color developing | 35.0 ± 0.3° C. | 45 sec |
| Bleach-fixing | 35.0 ± 0.5° C. | 45 sec |
| Stabilization | 30 to 34° C. | 90 sec |
| Drying | 60 to 80° C. | 60 sec |
| (Color developing solution) | | |
| Pure water | | 800 ml |
| Triethanol amine | | 10 g |
| N,N-diethylhydroxylamine | | 5 g |
| Potassium bromide | | 0.02 g |
| Sodium chloride | | 2 g |
| Potassium sulfite | | 0.3 g |
| 1-Hydroxyethylidene-1,1-diphosphonic acid | | 1.0 g |
| Ethylenediaminetetraacetic acid | | 1.0 g |
| Catechol-3,5-disulfonic acid disodium salt | | 1.0 g |
| N-ethyl-N-β-methanesulfonamidoethyl-3-methyl-4-aminoaniline.sulfate | | 4.5 g |
| Fluorescent brightener (4,4'-diamino-stilbenedisulfonic acid derivative) | | 1.0 g |
| Potassium carbonate | | 27 g |

made up to one liter with addition of water and adjusted to pH = 10.10.

| (Bleach-fixing solution) | |
|---|---|
| Iron (III) ammonium ethylenediamine-tetraacetate (dihydrate) | 60 g |
| Ethylenediaminetetraacetic acid | 3 g |
| Ammonium thiosulfate (70% solution) | 100 ml |

-continued

| | |
|---|---|
| Ammonium sulfite (40% solution) | 27.5 ml |
| made up to one liter with addition of water and adjusted to pH = 5.7 with potassium carbonate or glacial acetic acid. | |
| (Stabilizing solution) | |
| 5-Chloro-2-methyl-4-isothiazolin-3-one | 1.0 g |
| Ethylene glycol | 1.0 g |
| 1-Hydroxyetylidene-1,1-diphosphonic acid | 2.0 g |
| Ethylenediaminetetraacetic acid | 1.0 g |
| Ammonium hydroxide (20% solution) | 3.0 g |
| Fluorescent brightener (4,4'-diamino-Stilbenedisulfonic acid derivative) | 1.5 g |
| made up to one liter with addition of water and adjusted to pH = 7.0 with sulfuric acid or potassium hydroxide. | |

made up to one liter with addition of water and adjusted to pH = 7.0 with sulfuric acid or potassium hydroxide.

A color tone of the respective magenta color forming samples thus obtained at the density of 1.0 was measured by using a color analyzer 607 type (manufactured by Hitachi Ltd.).

Also, a magenta color image residual ratio of the same samples after irradiation of sunlight for 14 days was evaluated by using an under glass outdoor exposure stand and shown as "light resistance" in Table 1.

Further, turbid degree of a yellow image in the magenta image was determined by measuring the density at 440 nm as the standard, which was obtained by measuring the above color tone.

Furthermore, oozing of an oil component (hereinafter referred to "perspiration") from the uncolored sample surface after preservation in a thermostat at 85° C. and 60% RH (relative humidity) was observed.

The results are shown in Table 1.

○ . . . No perspiration was found.

Δ . . . A little amount of perspiration was found and involving practical problem.

× . . . Much amount of perspiration was found and practical use could not be effected

TABLE 1

| Sample No. | Magenta coupler | Anti-fading additive | kq ($M^{-1}s^{-1}$) | Added compound in Layer 2 and Layer 4* | Light resistance | Color turbidity Abs 440 | Perspiration |
|---|---|---|---|---|---|---|---|
| 1 (Comparative) | 10 | Comparative compound-1 | $>1 \times 10^7$ | Comparative compound A | 57 | 0.242 | X |
| 2 (Comparative) | 10 | Comparative compound-1 | $>1 \times 10^7$ | II-3 | 57 | 0.242 | Δ |
| 3 (Comparative) | 10 | 8 | $3 \times 10^7$ | Comparative compound A | 69 | 0.227 | X |
| 4 (Comparative) | 10 | 8 | $3 \times 10^7$ | Comparative compound A | 73 | 0.270 | X |
| 5 (This invention) | 10 | 8 | $3 \times 10^7$ | II-3 | 84 | 0.225 | ○ |
| 6 (Comparative) | 28 | Comparative compound-1 | $<1 \times 10^7$ | Comparative compound A | 59 | 0.242 | X |
| 7 (Comparative) | 28 | Comparative compound-1 | $<1 \times 10^7$ | II-3 | 62 | 0.242 | X |
| 8 (Comparative) | 28 | 8 | $3 \times 10^7$ | Comparative compound A | 72 | 0.227 | X |

TABLE 1-continued

| Sample No. | Magenta coupler | Anti-fading additive | kq ($M^{-1}s^{-1}$) | Added compound in Layer 2 and Layer 4* | Light resistance | Color turbidity Abs 440 | Perspiration |
|---|---|---|---|---|---|---|---|
| 9 (This invention) | 28 | 8 | $3 \times 10^7$ | II-3 | 88 | 0.225 | ○ |
| 10 (this invention) | 28 | 8 | $3 \times 10^7$ | II-2 | 87 | 0.225 | ○ |
| 11 (This invention) | 28 | 8 | $3 \times 10^7$ | II-8 | 87 | 0.225 | ○ |
| 12 (This invention) | 28 | 8 | $3 \times 10^7$ | II-14 | 87 | 0.224 | ○ |
| 13 (This invention) | 28 | 5 | $3 \times 10^7$ | II-3 | 85 | 0.224 | ○ |
| 14 (This invention) | 28 | 9 | $3 \times 10^7$ | II-3 | 89 | 0.225 | ○ |
| 15 (This invention) | 28 | 2 | $4 \times 10^7$ | II-3 | 84 | 0.226 | ○ |
| 16 (This invention) | 29 | 8 | $3 \times 10^7$ | II-3 | 87 | 0.224 | ○ |
| 17 (This invention) | 35 | 8 | $3 \times 10^7$ | II-3 | 87 | 0.225 | ○ |
| 18 (This invention) | 54 | 8 | $3 \times 10^7$ | II-3 | 85 | 0.226 | ○ |
| 19 (This invention) | 28 | 13 | $2 \times 10^7$ | II-3 | 85 | 0.226 | ○ |
| 20 (This invention) | 28 | 8, Compound C | $3 \times 10^7$, $0.7 \times 10^7$ | II-3 | 91 | 0.226 | ○ |
| 21 (This invention) | 28 | 8, Compound C | $3 \times 10^7$, $0.7 \times 10^7$ | II-3, Compound 1** | 92 | 0.225 | ○ |
| 22 (This invention) | 54 | 8 | $3 \times 10^7$ | II-8 | 85 | 0.226 | ○ |
| 23 (This invention) | 28 | 8, Compound C | $3 \times 10^7$, $0.7 \times 10^7$ | II-8 | 92 | 0.226 | ○ |
| 24 (This invention) | 28 | 8, Compound C | $3 \times 10^7$, $0.7 \times 10^7$ | II-8, Compound 1 | 92 | 0.226 | ○ |
| 25 (This invention) | 28 | 8 | $3 \times 10^7$ | II-8, Quinone product of II-8*** | 87 | 0.223 | ○ |
| 26 (This invention) | 54 | 8 | $3 \times 10^7$ | II-8, Quinone product of II-8 | 85 | 0.223 | ○ |
| 27 (This invention) | 28 | 8, Compound C | $3 \times 10^7$, $0.7 \times 10^7$ | II-8, Quinone product of II-8 | 92 | 0.223 | ○ |
| 28 (This invention) | 28 | 8, Compound C | $3 \times 10^7$, $0.7 \times 10^7$ | II-8, Quinone product of II-8, Compound 1, Quinone product of | 92 | 0.223 | ○ |

TABLE 1-continued

| Sample No. | Magenta coupler | Anti-fading additive | kq ($M^{-1}s^{-1}$) | Added compound in Layer 2 and Layer 4* | Light resistance | Color turbidity Abs 440 | Perspiration |
|---|---|---|---|---|---|---|---|
| | | | | Compound 1 | | | |

Comparative compound - 1

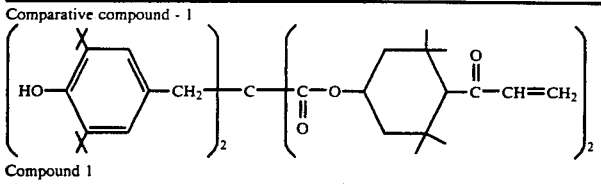

Compound 1

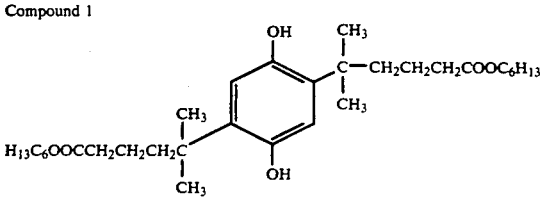

Comparative compound A

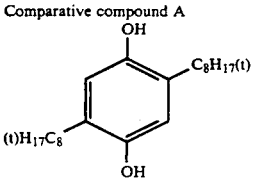

Comparative compound B

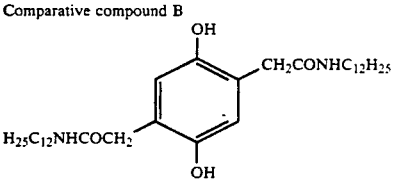

Comparative compound C

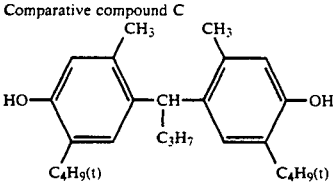

*Anti-fading additives in each sample and additive compounds in Layers 2 and 4 were each added with an equal mole to Sample 1.
**II-3 and Compound 1 were each added in an amount of 1/2 mole of the other samples.
***Quinone products in Samples No. 25 to No. 28 were each added in an amount of 1/100 mole per mole of each hydroquinone series compound.

As clearly seen from Table 1, in the samples of the present invention, light resistances are synergistically improved.

Also, in the samples of the present invention, there are unexpected results that color turbid is little and perspiration can be inhibited.

EXAMPLE 2

By using each of samples prepared in Example 1, each sample was subjected to running processing by 100 $m^2$ or more using an automatic developer which employs multi-step counter-current system, and then exposed and processed in the same manner as in Example 1.

Light resistance, color turbid degree and perspiration of the resulting respective samples were evaluated in the same manner as in Example 1.

As the results, the samples of the present invention showed good light resistance, little color turbidity and good perspiration inhibiting property, respectively.

As described above, the light-sensitive silver halide photographic material of the present invention solved the problem of color turbidity while maintaining the advantageous point of the coupler having good light resistance. According to the above, in the present invention, the effect of improving both of light resistance and color turbidity can be obtained and further the problem of perspiration can be solved.

I claim:

1. A light-sensitive silver halide photographic material having at least one light-sensitive emulsion layer and at least one non-light-sensitive emulsion layer on a support, the improvement wherein a coupler represented by the following formula (M−I) and an anti-fading additive having a quenching rate constant of a singlet oxygen of $1\times10^7 M^{-1}\cdot sec^{-1}$ or more are contained in at least one layer of the light-sensitive emulsion layer, and a compound represented by the following formula (II) is contained in at least one layer selected from the light-sensitive emulsion layer and the non-light-sensitive emulsion layer:

(M-I)

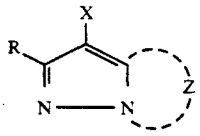

wherein Z represents a group of non-metallic atoms necessary for forming a nitrogen-containing heterocyclic ring, the ring formed by said Z may have a substituent(s), X represents hydrogen atom or an eliminatable group by the reaction with an oxidized product of a color developing agent, and R represents hydrogen atom or a substituent, (II)

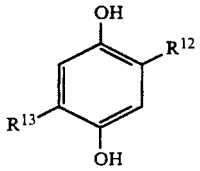

wherein $R^{12}$ and $R^{13}$ each represent secondary or tertiary alkyl group, provided that total carbon atoms of the alkyl groups represented by $R^{12}$ and $R^{13}$ are 20 or more and the anti-fading additive is a compound represented by the formula (D):

(D)

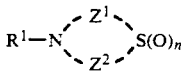

wherein $R^1$ represents an aryl group or a heterocyclic group; $Z^1$ and $Z^2$ each represent an alkylene group having 1 to 3 carbon atoms, provided that the total carbon atoms of the alkylene group represented by $Z^1$ and $Z^2$ are 3 to 6; and n is an integer of 1 or 2.

2. The material of claim 1 wherein the coupler represented by the formula (M−I) is a coupler represented by the formula selected from the group consisting of:

(M-II)

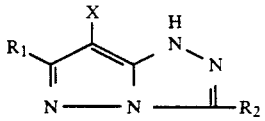

(M-III)

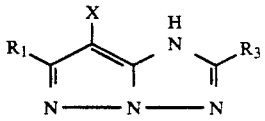

(M-IV)

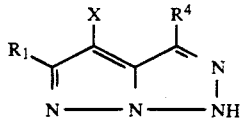

(M-V)

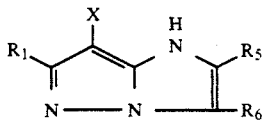

-continued (M-VI)

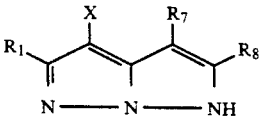

(M-VII)

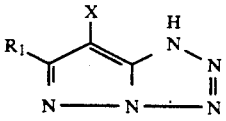

wherein $R_1$ to $R_8$ each have the same meaning as R defined in claim 1 and X has the same meaning as X in claim 1.

3. The material of claim 1 wherein the coupler represented by the formula (M−I) is a coupler represented by the formula (M−VIII).

(M-VIII)

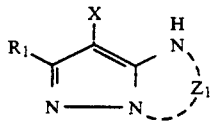

wherein $R_1$, X and $Z_1$ each have the same meanings as $R_1$, X and Z defined in claim 1, respectively.

4. The material of claim 1 wherein an amount of the coupler represented by the formula (M−I) is $1\times10^{-3}$ mole to 1 mole per mole of silver halide contained in a light-sensitive emulsion layer.

5. The material of claim 1 wherein $R^{12}$ or $R^{13}$ in the compound of the formula (II) is sec-decyl group, sec-docecyl group, sec-tetradecyl group, sec-pentadecyl group, sec-hexadecyl group, sec-octadecyl group, sec-eicosyl group, sec-triacontyl group, t-decyl group, t-dodecyl group, t-tetradecyl group, t-hexadeycl group, t-octadecyl group or t-eicosyl group.

6. The material of claim 1 wherein said compound of the formula (II) is selected from the group consisting of:

II-1

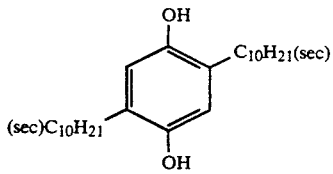

II-2

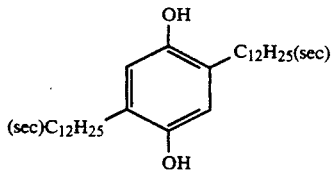

II-3

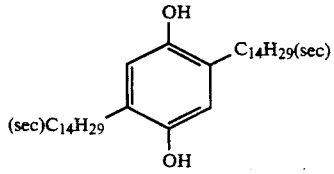

-continued

II-4

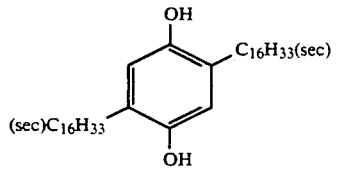

II-5

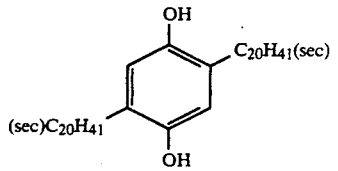

II-6

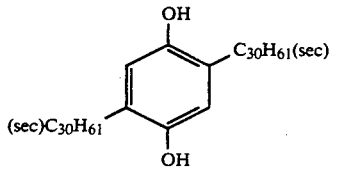

II-7

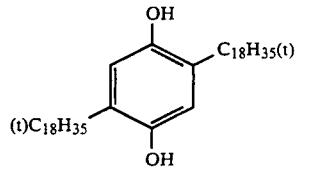

Reaction product of mixed $C_{12}$ to $C_{14}$ α-olefins and hydroquinone

II-8

Reaction product of mixed $C_{12}$ to $C_{18}$ α-olefins and hydroquinone

II-9

Reaction product of mixed $C_{16}$ to $C_{18}$ α-olefins and hydroquinone

II-10

II-11

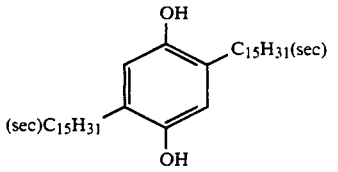

II-12

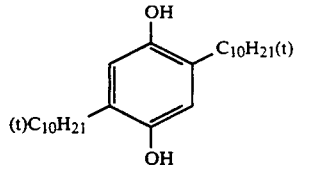

II-13

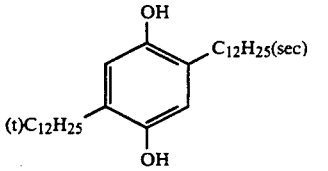

and

II-14

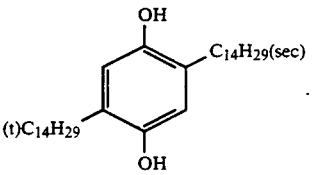

7. The material of claim 1 wherein the compound of the formula (II) is contained in a non-emulsion layer.

8. The material of claim 1 wherein the compound of the formula (II) is contained in a non-light-sensitive layer adjacent to a layer containing the magenta coupler.

9. The material of claim 8 wherein the compound of the formula (II) is contained in a non-light-sensitive layer positioned close to the support and adjacent to a layer containing the magenta coupler.

10. The material of claim 8 wherein a number average molecular weight of the compound represented by the formula (D) is 300 or more.

11. The material of claim 8 wherein a number average molecular weight of the compound represented by the formula (D) is 400 or more.

12. The material of claim 1 wherein the quenching rate constant of the anti-fading additive is $2.5\times10^{7}M^{-1}\cdot sec^{-1}$ or more.

13. The material of claim 1 wherein the quenching rate constant of the anti-fading additive is $3\times10^{7}M^{-1}\cdot sec^{-1}$ or more.

14. A light-sensitive silver halide photographic material having at least one light-sensitive emulsion layer and at least one non-light-sensitive emulsion layer on a support, the improvement wherein a coupler represented by the following formula (M−VIII) and an anti-fading additive having a quenching rate constant of a singlet oxygen of $1\times10^{7}M^{-1}\cdot sec^{-1}$ or more, represented by the following formula (D) and having a molecular weight of 400 or more are contained in at least one layer of the light-sensitive emulsion layer, and a compound represented by the following formula (II) is contained in the non-light-sensitive emulsion layer adjacent to a layer containing said magenta coupler;

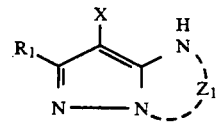

(M-VIII)

wherein Z represents a group of non-metallic atoms necessary for forming a nitrogen-containing heterocyclic ring, the ring formed by said Z may have a substitutent(s), X represents hydrogen atom or an eliminatable group by the reaction with an oxidized product of a color developing agent, and R represents hydrogen atom or a substituent,

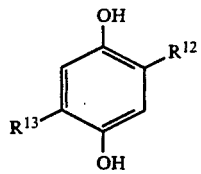

(II)

wherein $R^{12}$ and $R^{13}$ each represent sec-decyl group, sec-docecyl group, sec-tetradecyl group, sec-pentadecyl group, sec-hexadecyl group, sec-octadecyl group, sec-eicosyl group, sec-triacontyl group, t-decyl group, t-dodecyl group, t-tetradecyl group, t-hexadeycl group, t-octadecyl group or t-eicosyl group, provided that total carbon atoms of the alkyl groups represented by $R^{12}$ and $R^{13}$ are 20 or more,

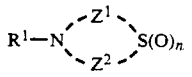
(D)
wherein $R^1$ represents an aryl group or a heterocyclic group; $Z^1$ and $Z^2$ each represent an alkylene group having 1 to 3 carbon atoms, provided that the total carbon atoms of the alkylene group represented by $Z^1$ and $Z^2$ are 3 to 6; and n is an integer of 1 or 2.
* * * * *